US009407036B2

(12) United States Patent
Andresen et al.

(10) Patent No.: US 9,407,036 B2
(45) Date of Patent: Aug. 2, 2016

(54) DEVICE FOR CLOSING A PLUG CONNECTOR HOUSING

(71) Applicant: PHOENIX CONTACT GMBH & CO. KG, Blomberg (DE)

(72) Inventors: Jens Andresen, Blomberg (DE); Jens Gerullis, Lemgo (DE); Thorsten Diessel, Hiddenhausen (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/381,222

(22) PCT Filed: Feb. 1, 2013

(86) PCT No.: PCT/EP2013/000314

§ 371 (c)(1),
(2) Date: Aug. 27, 2014

(87) PCT Pub. No.: WO2013/127487

PCT Pub. Date: Sep. 6, 2013

(65) Prior Publication Data

US 2015/0118888 A1 Apr. 30, 2015

(30) Foreign Application Priority Data

Feb. 28, 2012 (DE) ..... 10 2012 101 614.3

(51) Int. Cl.
*H01R 13/64* (2006.01)
*H01R 13/629* (2006.01)

(52) U.S. Cl.
CPC ..... *H01R 13/62933* (2013.01)

(58) Field of Classification Search
CPC ..... H01R 13/62933; H01R 13/6395; H01R 13/62938
USPC ..... 439/372, 373, 157
See application file for complete search history.

(56) References Cited

U.S. PATENT DOCUMENTS 5,022,866 A 6/1991 Harting et al.
5,398,164 A * 3/1995 Goodman et al. ..... 361/752
5,904,583 A * 5/1999 Katsuma ..... H01R 13/62933 439/157

(Continued)

FOREIGN PATENT DOCUMENTS

DE 3937022 C1 9/1999
DE 102004011509 A1 9/2005

(Continued)

*Primary Examiner* — Abdullah Riyami
*Assistant Examiner* — Thang Nguyen
(74) *Attorney, Agent, or Firm* — Leydig, Voit & Mayer, Ltd.

(57) ABSTRACT

A device for closing a plug connector housing which comprises a first housing part and a second housing part includes a locking element which comprises an elongate handle and two fastening portions which are each connected to the handle. The fastening portions each comprise a first web element and a second web element which are arranged with respect to one another in a V-shape. The web elements each comprise a free end portion for fastening to a bearing journal which is formed on the first housing part and the second housing part. A third web element having a curvature arranged between the first web element and the second web element such that the fastening portions each comprise a through-opening. The through-opening is delimited by the first web element, the second web element and the third web element.

12 Claims, 2 Drawing Sheets

(56) References Cited

U.S. PATENT DOCUMENTS

| | | | | |
|---|---|---|---|---|
| 7,494,352 | B2 * | 2/2009 | Furio | H01R 13/62955 439/157 |
| 2009/0258530 | A1 * | 10/2009 | Nehm | H01R 13/62966 439/372 |
| 2010/0136833 | A1 * | 6/2010 | Zwanger | H01R 13/516 439/607.55 |
| 2014/0179158 | A1 * | 6/2014 | Heggemann | H01R 13/514 439/556 |

FOREIGN PATENT DOCUMENTS

| | | | |
|---|---|---|---|
| DE | 202005005241 | U1 | 12/2005 |
| DE | 102008019016 | A1 | 10/2009 |
| DE | 102008059583 | A1 | 6/2010 |
| EP | 2110894 | A2 | 10/2009 |
| JP | 07058252 | A | 3/1995 |

* cited by examiner

DEVICE FOR CLOSING A PLUG CONNECTOR HOUSING

CROSS-REFERENCE TO RELATED APPLICATIONS

This application is a U.S. National Phase application under 35 U.S.C. §371 of International Application No. PCT/EP2013/000314, filed on Feb. 1, 2013, and claims benefit to German Patent Application No. DE 10 2012 101 614.3, filed on Feb. 28, 2012. The International Application was published in German on Sep. 6, 2013, as WO 2013/127487 A1 under PCT Article 21 (2).

FIELD

The invention relates to a device for closing a plug connector housing which comprises a first housing part and a second housing part, said device comprising a locking element having an elongate handle and two fastening portions, each of which is connected to the handle. The invention further relates to a plug connector comprising such a device.

BACKGROUND

A device of this type is known for example from DE 39 37 022 C1, in which the fastening portions are formed completely of a locking element in the shape of a loop and can each be arranged on a bearing journal of the first housing part and on a bearing journal of the second housing part so as to be able to close the first housing part with the second housing part in as secure a manner as possible. One drawback of such a design of the fastening portions of a locking element is that the fastening portions are very rigid owing to their design over the entire surface and thus the stresses on the bearing journal, in the region of the fastening of the fastening portions, that occur in particular when closing and opening the lock of the two housing parts are particularly high. Particularly high loads occur in this region as a result, and these can quickly lead to material fatigue in which, in the worst case scenario, part of the fastening portion can break off and as a result, the locking element no longer functions properly.

SUMMARY

In an embodiment, the present invention provides a device for closing a plug connector housing which comprises a first housing part and a second housing part. The device includes a locking element which comprises an elongate handle and two fastening portions which are each connected to the handle. The fastening portions each comprise a first web element and a second web element which are arranged with respect to one another in a V-shape. The web elements each comprise a free end portion for fastening to a bearing journal which is formed on the first housing part and the second housing part. A third web element having a curvature arranged between the first web element and the second web element such that the fastening portions each comprise a through-opening. The through-opening is delimited by the first web element, the second web element and the third web element.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
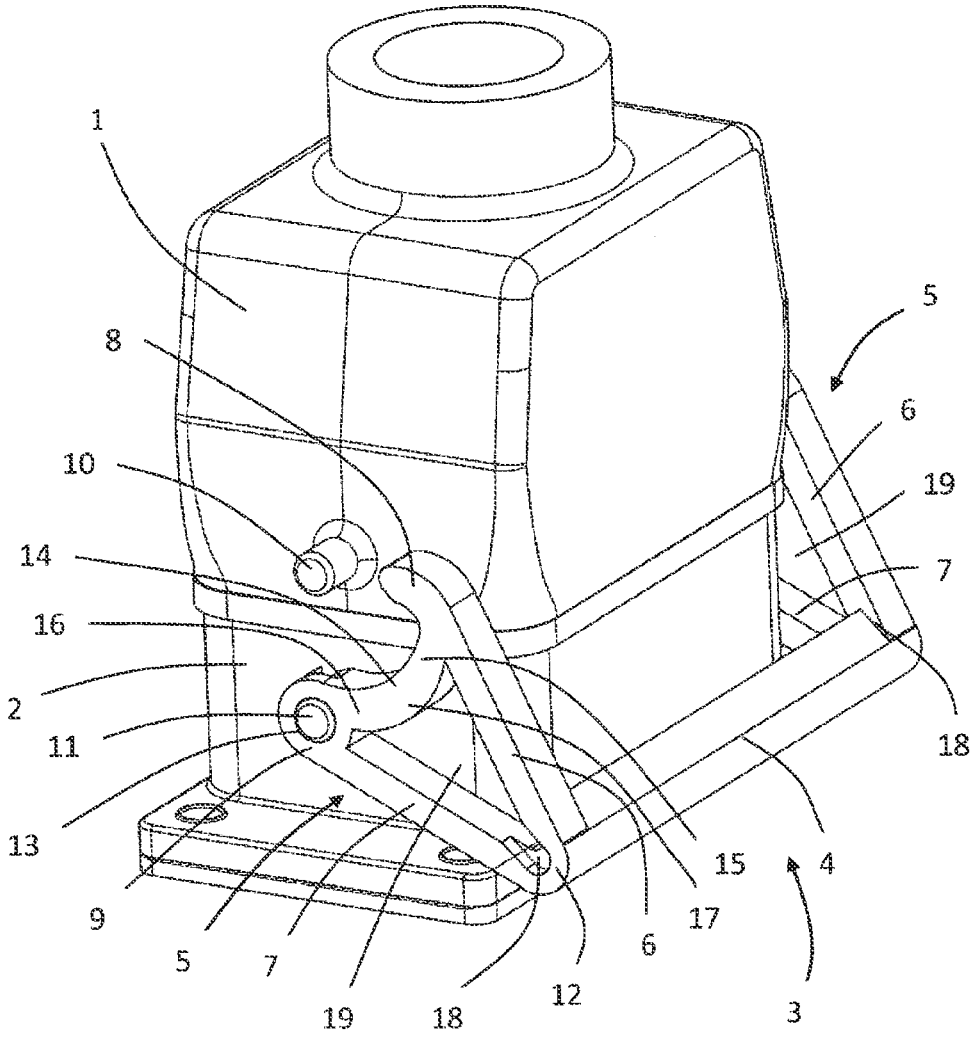
FIG. 1 is a schematic view of a plug connector having a device for closing the plug connector housing according to the invention in a first position.

In one aspect, the invention provides both a device for closing a housing and a plug connector, which are characterised by relatively high stability and a relatively long usage life.

In one embodiment, fastening portions each comprise a first web element and a second web element which are arranged with respect to one another in a V shape and each have a free end portion for fastening to the bearing journal which is formed on the first housing part and on the second housing part, at least one third web element having a curvature being arranged between the first web element and the second web element, such that the fastening portions each comprise a through-opening which is delimited by the first web element, the second web element and the third web element.

In another embodiment, the invention provides a plug connector comprising a housing, which comprises a first housing part and a second housing part, and a device for closing the housing.

The device for closing a housing comprises a locking element, the fastening portions of which, by means of which the locking element is fastened to the housing, have improved compensation of tolerance and improved endurance strength, even in cases of high humidity and/or heat, with respect to conventional locking elements and can also be produced in a cost-effective manner. To achieve this, the fastening portions are formed according to the invention such that the stresses occurring in the fastening portions are distributed in as uniform a manner as possible across the entire fastening portion, so that peak stresses in just one region of a fastening portion can be prevented. For this purpose, the fastening portions are formed of a first web element, a second web element and at least one third web element. The first web element and the second web element are preferably substantially straight and connected to an end portion of the handle of the locking element at a common fastening point. Starting from this common fastening point on the handle, the first web element and the second web element extend away from the fastening point such that they form a V-shape. Opposite the fastening point, the first web element and the second web element each comprise a free end portion, on which the web elements on the bearing journal, which is formed on the two housing parts, can engage. In this case, the first web element can preferably be fastened with its free end portion to a bearing journal of the first housing part and the second web element can preferably be fastened with its free end portion to a bearing journal of the second housing part.

In addition to the fastening point, at which the first web element is directly connected to the second web element, the first web element and the second web element are interconnected by means of at least one third web element. The third web element is at a distance from the fastening point such that a through-opening is formed between the fastening point and the third web element, which through-opening is delimited by the first web element, the second web element and the third web element. What is achieved by the third web element and the through-opening formed thereby is that the fastening portions are formed to be resilient but at the same time have high, long-lasting dimensional stability. The resilience allows the loads acting upon the fastening portions to be absorbed and damped. Damage to the fastening portions caused by loads of this type, as can occur when fastening portions have a rigid design, can be prevented by the resilience, according to the invention, of the fastening portions. Depending on the load acting upon the respective fastening portions, the web elements can deform freely owing to the through-opening. To allow this deformation, the third web element has a curvature, in particular an arcuate curvature, the curvature preferably being formed such that the curvature is formed towards the fastening point. Owing to the curvature, the third web element acts in a similar way to a disc spring. The degree of curvature and also the cross-sectional area of the third web element can be set individually according to the magnitude of the load, it being possible to adjust the resilience and also the locking force of the fastening portions and thus also of the locking element by means of the size of the curvature and the size of the cross-sectional area. In order to achieve a particularly good stress distribution over a fastening portion, the first web element, the second web element and the third web element have substantially the same cross-sectional area. In this case, a fastening portion can comprise a third web element or even two or more than two third web elements. The provision of two or more than two third web elements makes it possible to prevent lateral outward bending of a fastening portion, the resilience of the fastening portion, however, not being reduced. The fastening portions each have a first web element, a second web element and at least one third web element, which are preferably formed integrally with one another. In addition, the fastening portions are preferably also formed integrally with the handle. Moreover, the entire locking element is preferably formed from just one material, preferably a plastics material.

According to a preferred configuration of the invention, the third web element is connected to the free end portion of the first web element and/or to the free end portion of the second web element. As a result, the spacing of the third web element is designed to be as remote as possible from the fastening point, so that the through-opening between the first, the second and the third web element can be designed to be particularly large. This allows the fastening portion to have particularly high resilience, whereby it is also possible in turn to achieve a stress distribution over the entire fastening portion that is further optimised.

The third web element preferably comprises a first end portion and a second end portion, the third web element preferably being connected with its first end portion to the first web element and with its second end portion to the second web element, the first end portion and the second end portion preferably having a smaller cross-sectional area than the region of the third web element that is formed between the first end portion and the second end portion. By reducing the cross-sectional area of the third web element towards its end portions, which are respectively connected to the first web element and the second web element, the spring effect of the third web element can be improved further, it thereby being possible to improve the resilience and thus the stress distribution of the entire fastening portion. It is preferably provided that the end portions of the third web element have a cross-sectional area that is reduced by substantially 20% with respect to the cross-sectional area along the middle of the third web element between the two end portions.

Another preferred configuration of the invention provides that the third web element comprises one or more slits. The slits, which are preferably in the form of elongate, narrow through-openings, preferably extend over the length of the third web element and bring about an increase in the spring action of the third web element, so that the resilience and thus the stress distribution of an entire fastening portion can also be increased by providing slits in the third web element.

In order to achieve particularly high dimensional stability and at the same time sufficient resilience of the fastening portions, the locking element is preferably formed of a reinforced plastics material, in particular a carbon-fibre-reinforced or a glass-fibre-reinforced plastics material. By using a carbon-fibre-reinforced plastics material in particular, it is possible to achieve a particularly high elastic modulus of the material of the locking element, whereby particularly good endurance strength of the locking element can be achieved even after many years and with strong vibrations, and therefore the fastening portions have particularly good long-lasting dimensional stability. Polyamide is preferably used as the plastics material.

The invention will be described in more detail below with reference to a preferred embodiment and the accompanying drawings.

Figure 2:
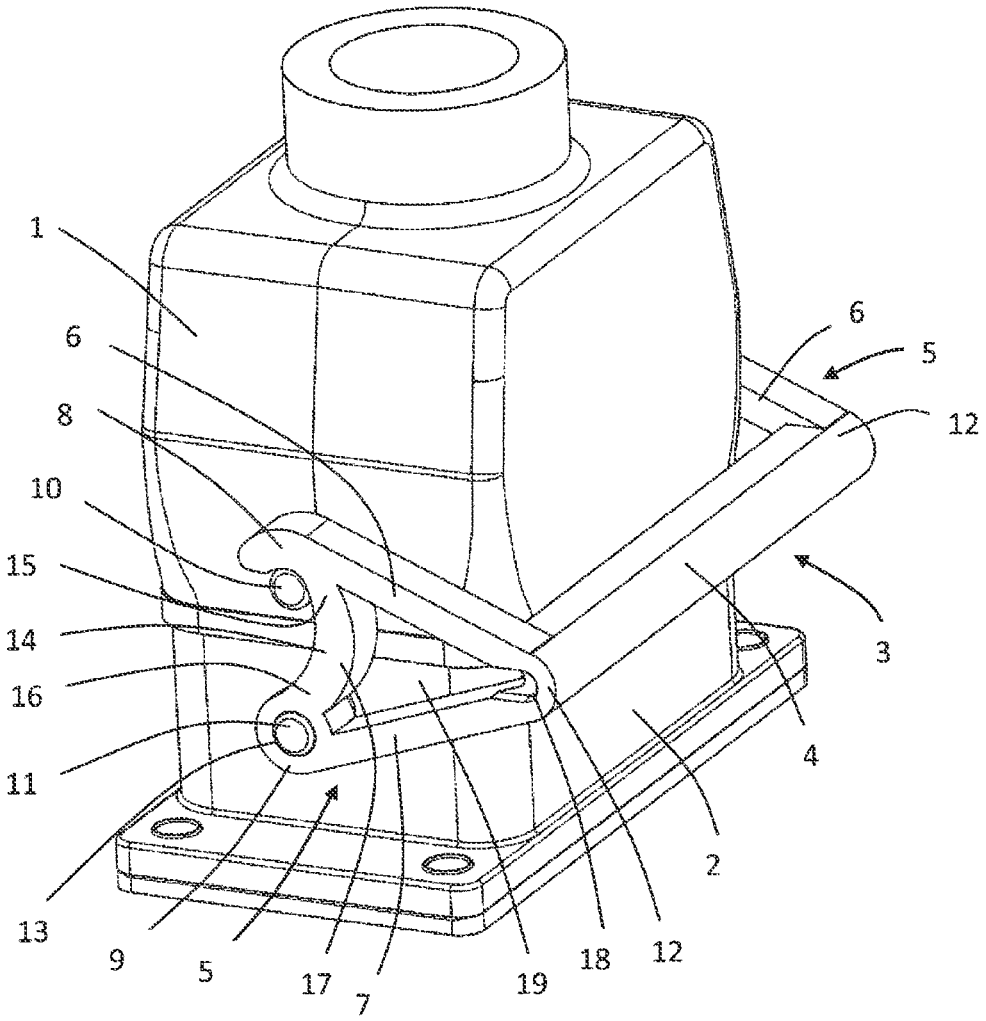
FIG. 2 is a schematic view of the plug connector having the device for closing the plug connector housing according to the invention in a second position.

FIGS. 1 and 2 show a plug connector according to the invention, which comprises a housing comprising a first housing part 1 and a second housing part 2. The two housing parts 1, 2 are formed such as to be releasable from one another in that the first housing part 1 can be lifted off the second housing part 2. To close the housing, the first housing part 1 is placed back onto the second housing part 2 and closed by a locking element 3 so that the two housing parts 1, 2 rest one on top of the other in a secure manner. FIG. 1 shows said locking element 3 in an open position and FIG. 2 shows said locking element 3 in a locked position.

The locking element 3 comprises an elongate handle 4 which extends transversely over the entire longitudinal side face of the housing. The locking element 3 further comprises two mutually opposed fastening portions 5 which are each integrally connected to the handle 4 at one end of the handle 4 and extend at a right angle to the longitudinal axis of the handle 4.

The fastening portions 5 each comprise a first web element 6 and a second web element 7 which are arranged with respect to one another in a V-shape and which each comprise a free end portion 8, 9 for fastening to a bearing journal 10, 11 which is formed on the first housing part 1 and on the second housing part 2. The first web element 6 and the second web element 7 are substantially straight and are connected to an end portion of the handle 4 of the locking element 3 at a common fastening point 12. A reduction in material in the form of a notch 18 is formed in the region of the fastening point 12, whereby the spring effect of the first web element 6 and the second web element 7 can be improved. Starting from this common fastening point 12, the first web element 6 and the second web element 7 extend away from the fastening point 12 such that they form a V shape. Opposite the fastening point 12, the first web element 6 and the second web element 7 each comprise a free end portion 8, 9, on which the web elements 6, 7 on the bearing journal 10, 11, which is formed on the two housing parts 1, 2, can engage. In this case, the first web element 6 can be fastened with its free end portion 8 to the bearing journal 10 of the first housing part 1 and the second web element 7 is fastened with its free end portion 9 to the bearing journal 11 of the second housing part 2. The free end portion 9 of the second web element 7 comprises a circular through-opening 13, through which the bearing journal 11 of the second housing part 2 is guided, so that the bearing journal 11 of the second housing part 2 is enclosed by the free end portion 9 of the second web element 7. The free end portion 9 of the second web element 7 thus forms a centre of rotation for the locking element 3, about which the locking element 3 can be pivoted or rotated in order to be able to be transferred from the locked position into the open position and vice versa. The locking element 3 is thus captively fastened to the second housing part 2 via the free end portion 9 of the second web element 7. The free end portion 8 of the first web portion 6, however, is curved, in particular curved towards the free end portion 9 of the second web element 7, so that the free end portion 8 of the first web element 6 can engage, in the manner of a "claw" or a "clutch", around the bearing journal 10 of the first housing part 1 in the locked position, as shown in FIG. 2. As shown in FIG. 1, however, in the open position, the free end portion 8 of the first web element 6 pivots away from the bearing journal 10 of the first housing part 1, so that the first housing part 1 can be lifted off the second housing part 2.

The fastening portions 5 each further comprise a third web element 14 which is arranged between the first web element 6 and the second web element 7. The third web element 14 is at a distance from the fastening point 12, so that a through-opening 19 is formed between the fastening point 12 and the third web element 14, which through-opening is delimited by the first web element 6, the second web element 7 and the third web element 14 such that the through-opening 19 is substantially triangular. The third web element 14 has an arcuate curvature, the curvature preferably being formed such that the curvature is towards the fastening point 12. Owing to the curvature, the third web element 14 acts in a similar manner to a disc spring. The through-opening 19 is formed to be as large as possible in that the third element 14 is connected to the free end portions 8, 9 of the first and the second web element 6, 7. The third web element 14 further comprises a first end portion 15 and a second end portion 16, by means of which the third web element 14 is connected to the first and the second web element 6, 7, the first end portion 15 and the second end portion 16 having a smaller cross-sectional area than the region 17 in the middle of the third web element 14 between the first end portion 15 and the second end portion 16 of the third web element 14.

The locking element 3 is formed of a uniform material, in particular a plastics material, a carbon-fibre-reinforced plastics material preferably being used therefor. Here, the fastening portions 5 themselves and also the connection of the fastening portions 5 to the handle 4 are formed integrally.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

List of Reference Numerals

First housing part 1
Second housing part 2
Locking element 3
Handle 4
Fastening portion 5
First web element 6
Second web element 7
Free end portion 8
Free end portion 9
Bearing journal 10
Bearing journal 11
Fastening point 12
Through-opening 13
Third web element 14
First end portion 15
Second end portion 16
Region 17
Notch 18
Through-opening 19

The invention claimed is:

1. A device for closing a plug connector housing which comprises a first housing part and a second housing part, said device comprising:

a locking element which comprises an elongated handle and two fastening portions which are each connected to the handle, wherein the fastening portions each comprise a first web element and a second web element which are arranged with respect to one another in a V-shape and which each comprise a free end portion for fastening to a bearing journal which is formed on the first housing part and the second housing part; and at least one third web element having an arcuate curvature being arranged between the first web element and the second web element, such that the fastening portions each comprise a through-opening which is delimited by the first web element, the second web element and the third web element, wherein the first web element, the second web element, and the third web element are formed integrally with one another, and wherein the first web element, the second web element, and the third web element are deformable such that the two fastening portions are resilient.

2. The device according to claim 1, wherein the third web element is connected to at least one of the free end portion of the first web element or to the free end portion of the second web element.

3. The device according to claim 1, wherein the third web element comprises a first end portion and a second end portion, the third web element being connected with the first end portion to the first web element and with the second end portion to the second web element, the first end portion and the second end portion having a smaller cross-sectional area than a region of the third web element that is formed between the first end portion and the second end portion.

4. The device according to claim 1, wherein the third web element comprises at least one slit.

5. The device according to claim 1, wherein the locking element is formed of a reinforced plastics material.

6. The device, according to claim 5, wherein the reinforced plastics material is at least one of a carbon-fibre-reinforced or a glass-fibre-reinforced plastics material.

7. The device according to claim 1, wherein the through-opening is deformable.

8. The device according to claim 1, wherein the third web element is configured to act as a disc spring.

9. The device according to claim 1, wherein the arcuate curvature of the at least one third web element is formed towards a common fastening point at which the first web element and the second web element are connected to an end portion of the handle.

10. The device according to claim 1, wherein a reduction in material in the form of a notch is formed in the region a common fastening point at which the first web element and the second web element are connected to an end portion of the handle.

11. The device according to claim 1, wherein a portion of the through opening delimited by the third web element has an arcuate curvature formed towards a common fastening point at which the first web element and the second web element are connected to an end portion of the handle.

12. A plug connector comprising:

a housing, which comprises a first housing part and a second housing part; and a device for closing the housing comprising:

a locking element which comprises an elongated handle and two fastening portions which are each connected to the handle, wherein the fastening portions each comprise a first web element and a second web element which are arranged with respect to one another in a V-shape and which each comprise a free end portion for fastening to a bearing journal which is formed on the first housing part and the second housing part; and at least one third web element having an arcuate curvature being arranged between the first web element and the second web element, such that the fastening portions each comprise a through-opening which is delimited by the first web element, the second web element and the third web element, wherein the first web element, the second web element, and the third web element are formed integrally with one another, and wherein the first web element, the second web element, and the third web element are deformable such that the two fastening portions are resilient.

* * * * *